US007062979B2

(12) United States Patent
Day et al.

(10) Patent No.: US 7,062,979 B2
(45) Date of Patent: Jun. 20, 2006

(54) TOOL AND ASSOCIATED METHODS FOR CONTROLLABLY APPLYING TORQUE TO A FASTENER

(75) Inventors: Dean W. Day, Haysville, KS (US); Donald E. Rose, Derby, KS (US); Austin B. Young, Derby, KS (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/391,836

(22) Filed: Mar. 19, 2003

(65) Prior Publication Data

US 2004/0182175 A1 Sep. 23, 2004

(51) Int. Cl.
*B25B 23/14* (2006.01)

(52) U.S. Cl. ..... 73/862.22

(58) Field of Classification Search .....
73/862.21–862.23, 862, 862.08–862.17; 318/254, 138, 439
See application file for complete search history.

(56) References Cited

U.S. PATENT DOCUMENTS 3,572,447 A * 3/1971 Pauley et al. ..... 173/182
3,696,871 A * 10/1972 Stenbacka ..... 173/178
4,106,570 A * 8/1978 Eshghy et al. ..... 173/183
4,208,555 A * 6/1980 Ikeda et al. ..... 200/52 R
4,485,698 A * 12/1984 Adman et al. ..... 81/57.11
4,571,696 A 2/1986 Bitzer
4,620,449 A * 11/1986 Borries et al. ..... 73/862.21
5,014,793 A * 5/1991 Germanton et al. ... 73/862.193
5,070,750 A * 12/1991 Jones et al. ..... 29/240
5,277,527 A * 1/1994 Yokota et al. ..... 408/139
5,609,077 A * 3/1997 Ohmi et al. ..... 81/57.13
5,731,673 A * 3/1998 Gilmore ..... 318/432
5,738,177 A * 4/1998 Schell et al. ..... 173/178
5,903,462 A * 5/1999 Wagner et al. ..... 700/168
5,918,201 A 6/1999 Szwast et al.
6,134,973 A * 10/2000 Schoeps ..... 73/862.23
6,155,355 A * 12/2000 Holmin ..... 173/176
6,318,189 B1 11/2001 Donaldson
6,424,799 B1 * 7/2002 Gilmore ..... 388/811
6,538,403 B1 * 3/2003 Gorti et al. ..... 318/254
6,598,684 B1 * 7/2003 Watanabe ..... 73/862.23

OTHER PUBLICATIONS

S^CHAT^Z® *Advanced Quality—Home—Inspect*; 2001 SCHATZ USA Inc; 6 pages; available at <http://www.schatz-usa.com> and <http://www.schatz-usa.com/prod02.htm> (visited Jan. 10, 2003).

* cited by examiner

*Primary Examiner*—Max Noori
(74) *Attorney, Agent, or Firm*—Alston & Bird LLP

(57) ABSTRACT

A torque tool and an associated method are provided which apply operator-defined levels of torque to a threaded fastener. In one aspect, a portable, battery powered torque tool controls the motor to slow further advancement of the threaded fastener once the torque that has been applied to the threaded fastener has reached a predefined threshold. In another aspect, a torque tool monitors a measure of torque applied to a threaded fastener more frequently once the torque applied to the threaded fastener has reached a predefined threshold. A method of defining a mathematical relationship between a first measure provided by a torque transducer of torque applied to a threaded fastener and a second measure provided by a torque measurement reference device of torque applied to the threaded fastener is also provided such that the measure of torque provided by the torque transducer can be calibrated.

26 Claims, 5 Drawing Sheets

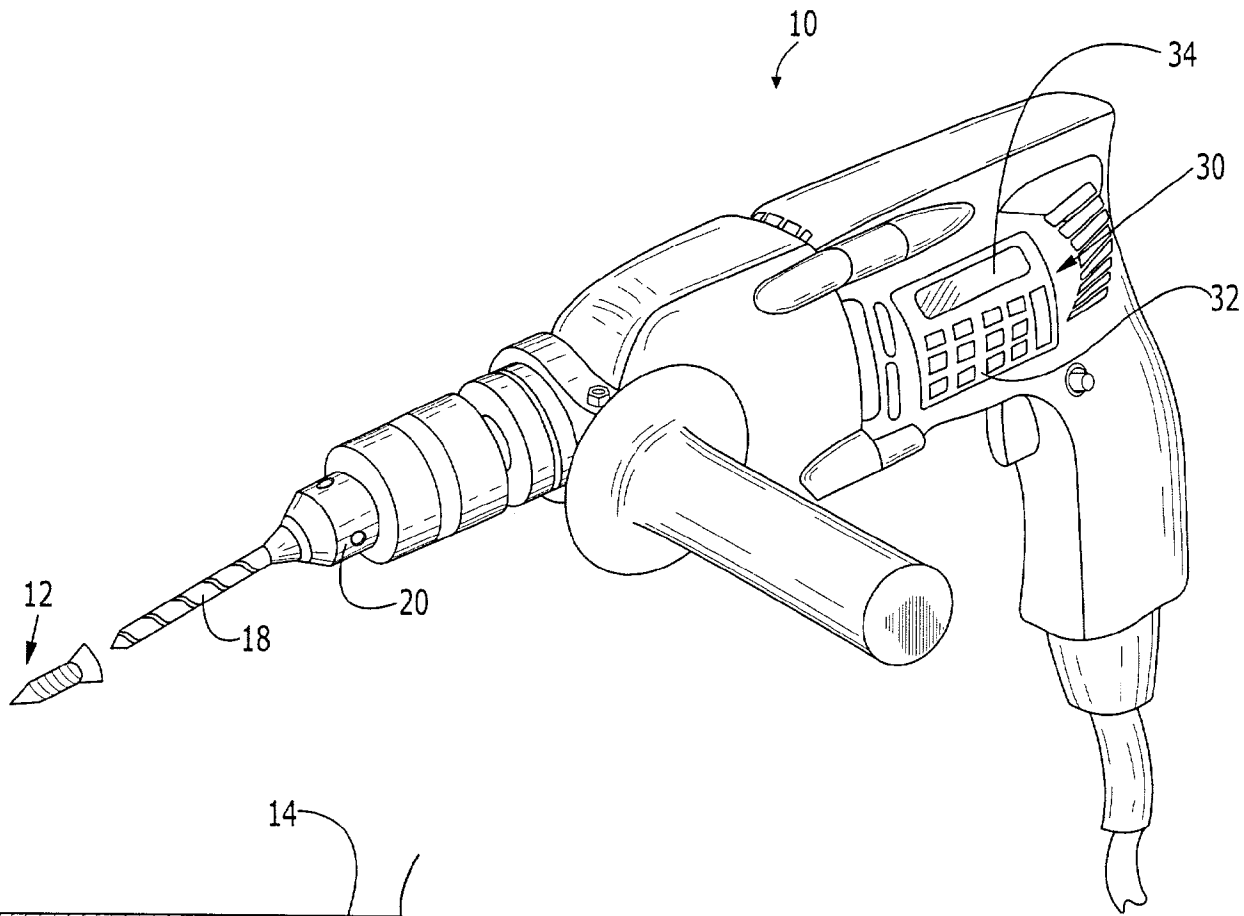
FIGURE 1
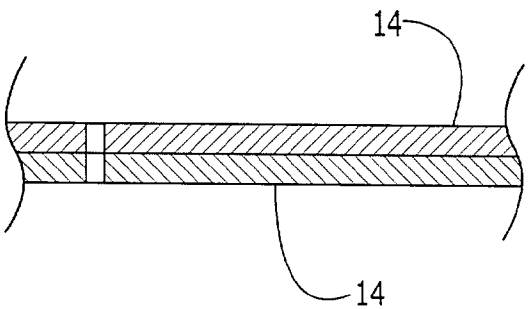

TOOL AND ASSOCIATED METHODS FOR CONTROLLABLY APPLYING TORQUE TO A FASTENER

FIELD OF THE INVENTION

The present invention relates generally to a torque tool and associated methods for controllably applying torque to a threaded fastener and, in one embodiment, to a battery powered, portable torque tool for monitoring the torque applied to a threaded fastener such that the threaded fastener may installed to a desired final torque value, such as a desired final torque value selected by an operator.

BACKGROUND OF THE INVENTION

In order to install threaded fasteners, such as screws, bolts, nuts or the like, a torque tool is utilized to apply the necessary torque. Various types of torque tools are available, including wrenches, screwdrivers and other power tools, for engaging the threaded fastener and rotatably advancing the threaded fastener by the application of torque thereto. As such, torque tools permit threaded fasteners to be installed in a wide variety of workpieces, including the threaded fasteners installed during the assembly of an aircraft, an automobile and a wide variety of other structures.

In installing a threaded fastener, it is generally desired to tighten the threaded fastener until the threaded fastener is appropriately stretched or tensioned, thereby insuring that the threaded fastener securely engages the workpiece(s) in which the fastener is installed. In this regard, the desired tension in the fastener may be determined in advance by a design engineer to ensure that the structure is appropriately secured by the threaded fasteners. However, it is difficult to directly determine the tension in an installed fastener. In this regard, although the tension could be readily calculated if the variation in the length of the installed fastener from the nominal length of the fastener could be determined, the length of most installed fasteners cannot be readily measured.

As such, the torque applied to the threaded fastener is more commonly specified and measured since the tension in the fastener can be estimated based upon the applied torque. In installing threaded fasteners, it is therefore desirable to threadably insert a fastener until the desired torque has been applied to the fastener since completing the installation of a fastener without applying sufficient torque may not adequately fasten the workpiece(s). Conversely, applying excessive torque during the installation of a fastener may damage the workpiece(s). As such, handheld power tools may be configured to install a fastener with a predetermined amount of torque.

For example, pneumatic and hydraulic power tools are available that have a target torque setting. As such, these power tools will install a threaded fastener with the application of the target torque. However, pneumatic and hydraulic power tools having a target torque setting cannot be re-configured in the field or along the assembly line to have a different target torque setting. Instead, the pneumatic and hydraulic power tools must be returned to a calibration laboratory in order to change the target torque setting. Since many assembly processes require different fasteners to be installed to different levels of torque, one solution is to provide a multiplicity of torque tools with each tool configured to install threaded fasteners to a different level of torque. Alternatively, a single torque tool may be utilized, but the torque tool must be repeatedly returned to the calibration laboratory in order to be reset to have different target torque settings, as required by the assembly operation. Each of these approaches has disadvantages, however, in that the use of multiple torque tools requires the purchase and maintenance of additional torque tools which, in turn, increases the overall capital and operational costs of the assembly process. In addition, the repeated recalibration of a single torque tool to multiple target torque settings decreases the overall efficiency of the assembly process, since the torque tool must be repeatedly taken off line for some period of time to re-calibrate the torque tool. Moreover, pneumatic and hydraulic power tools must disadvantageously remain tethered to a pneumatic or hydraulic power supply.

Handheld power tools designed to apply torque to threaded fasteners are also available that are powered by alternating current (AC). In this regard, AC torque tools have been developed that include a number of preset target torque settings. As such, an operator can push an appropriate button on the user interface of the AC torque tool in order to select an appropriate target torque setting prior to installing threaded fasteners to the selected target torque value. However, these AC torque tools are generally quite large and expensive tools and, as a result, are not widely utilized. Moreover, AC power tools also must disadvantageously remain electrically connected to an AC power supply.

Accordingly, it would be desirable to provide a torque tool that permits the operator to readily select the target torque settings such that a single torque tool could be utilized to apply various levels of torque to threaded fasteners without having to return to a calibration laboratory or otherwise remove the torque tool from service. Additionally, it would be advantageous to provide a torque tool that was readily portable and was not tethered to a stationary power supply, such a pneumatic or hydraulic power supply or an AC power line, as required by conventional torque tools.

BRIEF SUMMARY OF THE INVENTION

An improved torque tool and an associated method are provided according to the present invention which apply various operator-defined levels of torque to a threaded fastener. According to one aspect of the present invention, a portable, battery powered torque tool and an associated installation method are provided which control the motor so as to slow further advancement of the threaded fastener once the torque that has been applied to the threaded fastener has reached a predefined threshold. According to another aspect of the present invention, a torque tool and associated installation method are provided for receiving and monitoring a measure of torque applied to a threaded fastener at more frequent intervals once the torque applied to the threaded fastener has reached a predefined threshold. As such, the torque tool and associated installation methods of these aspects of the present invention permit a more controlled installation of the threaded fastener to a desired final torque value, typically defined by the operator. A method of defining a mathematical relationship between a first measure provided by a torque transducer of torque applied to a threaded fastener and a second measure provided by a torque measurement reference device of torque applied to the threaded fastener is also provided such that the measure of torque provided by the torque transducer can be calibrated, thereby further improving the consistency and accuracy with which the torque tool installs a threaded fastener.

According to one aspect of the present invention, a portable, battery operated torque tool and an associated installation method are provided for slowing further advancement of the threaded fastener once the torque applied to the threaded fastener has reached a predefined threshold. In this regard, power is provided to the portable torque tool with at least one battery. In response, the portable torque tool and, in particular, the motor of the portable torque tool applies torque to the threaded fastener to thereby advance the threaded fastener. A measure of the torque applied to the threaded fastener is obtained, such as by a torque transducer, and is repeatedly reviewed to determine when the torque applied to a threaded fastener has reached a predefined threshold. In this regard, the measure of torque applied to a threaded fastener is provided to a processing element that at least partially controls operation of the motor. The processing element receives the measure of torque applied to a threaded fastener and determines when the applied torque has reached the predefined threshold. While this threshold may be defined in various manners, the predefined threshold of one embodiment is a predefined percentage, such as 50%, of a desired final torque value. Upon determining that the torque applied to a threaded fastener has reached the predefined threshold, further advancement of the threaded fastener may be slowed such as by appropriate control of the motor by the processing element. By slowing further advancement of the threaded fastener, the torque tool and associated installation method can more precisely halt further advancement of the threaded fastener upon reaching the desired final torque value, thereby avoiding over-tightening of the threaded fastener. By providing power to the motor with one or more batteries, however, the torque tool is readily portable and is not tethered to a stationary power supply.

According to another aspect of the present invention, a torque tool and associated method for installing a threaded fastener are provided that receive and process the measure of torque applied to the threaded fastener at more frequent intervals once the torque applied to the threaded fastener has reached a predefined threshold. According to this aspect, torque is applied to a threaded fastener, such as by a motor, and the measure of torque applied to a threaded fastener is provided, such as by a torque transducer to a processing element that at least partially controls operation of the motor. From the measure of torque applied to the threaded fastener, it can be determined when the torque applied to the threaded fastener has reached the predefined threshold, such as a predetermined percentage of a desired final torque value. Once the torque applied to a threaded fastener has reached the predefined threshold, the measure of torque applied to the threaded fastener may be received or sampled at more frequent intervals. By sampling the measure of torque applied to a threaded fastener more frequently, the torque tool and associated installation method of this aspect of the present invention can again more readily halt further advancement of the threaded fastener upon application of the desired final torque value, thereby further avoiding over-tightening of the threaded fastener. As before, the torque tool of this aspect of the present invention may be powered by at least one battery, thereby similarly increasing the portability of the torque tool.

According to either of these aspects of the present invention, the motor may include a pair of power terminals and the processing element may be configured to direct that the pair of power terminals be electrically shorted once the torque applied to the threaded fastener has reached a desired final torque value. By shorting the pair of power terminals, the application of torque to the threaded fasteners is halted at or near the desired final torque value. In one advantageous embodiment, the torque tool also includes a user interface in communication with the processing element for permitting operator entry of the desired final torque value. As such, the torque tool and associated installation methods can install threaded fasteners with a wide variety of desired final torque values that may be selected by the operator and are not limited to one or a set of predefined torque values. Moreover, this selection of the desired final torque value may occur in the field without returning the torque tool to a calibration laboratory or the like.

According to another aspect of the present invention, a method is provided of calibrating the measure of torque applied to a threaded fastener that is provided by a torque transducer. In this regard, at least one threaded fastener is repeatedly installed with different amounts of torque applied to the threaded fastener(s) during at least two of the installations. The torque applied to the threaded fastener during each installation is measured by both the torque transducer and a torque measurement reference device. The torque transducer will be an integral part of the torque tool during normal operation, while the torque measurement reference device is utilized to provide a reference measurement of the torque applied to the threaded fastener for purposes of calibrating the torque transducer. As such, the measure of torque applied to the threaded fastener that is provided by the torque measurement reference device is generally more precise than that provided by the torque transducer. The torque transducer and the torque measurement reference device provide first and second measures, respectively, of the torque applied during each installation. Typically, the torque measurement reference device provides a direct measure of the torque, such as in Newton meters or the like. Alternatively, the torque transducer generally provides a value indirectly representative of the torque. In order to relate the value provided by the torque transducer to the torque that has been applied to the threaded fastener, a mathematical relationship is determined that relates the first and second measures of torque provided by the torque transducer and the torque measurement reference device, respectively. While the mathematical relationship may be defined in various ways, a regression analysis, such as a linear regression analysis, may be employed to mathematically relate the first and second measures of the torque. By appropriately relating the first and second measures of torque provided by the torque transducer and torque measurement reference device, respectively, the measure of torque provided by the torque transducer during normal operation of the torque tool can be accurately translated into actual values of torque that have been applied to the threaded fastener.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 1 is a torque tool according to one embodiment of the present invention;

Figure 4:
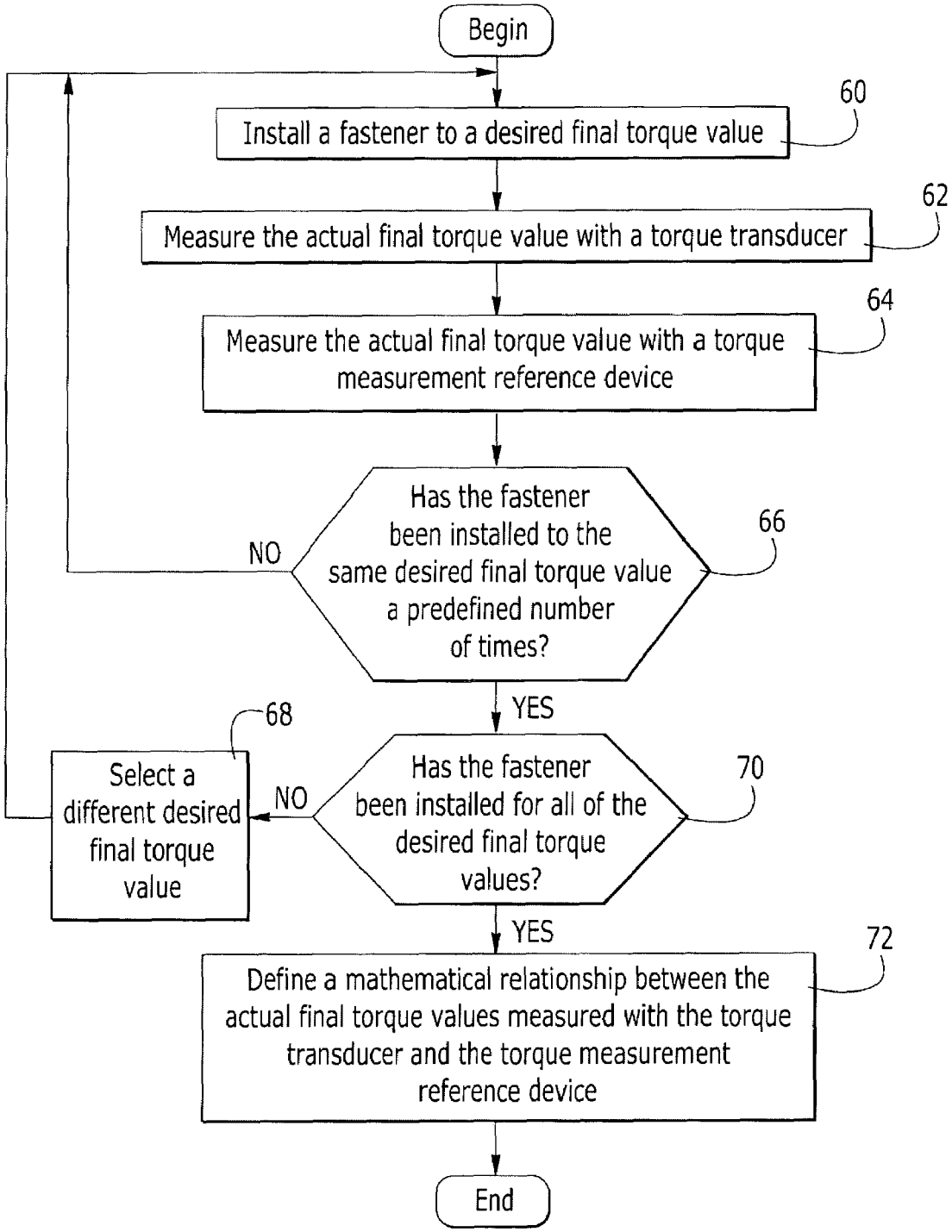
Figure 5:
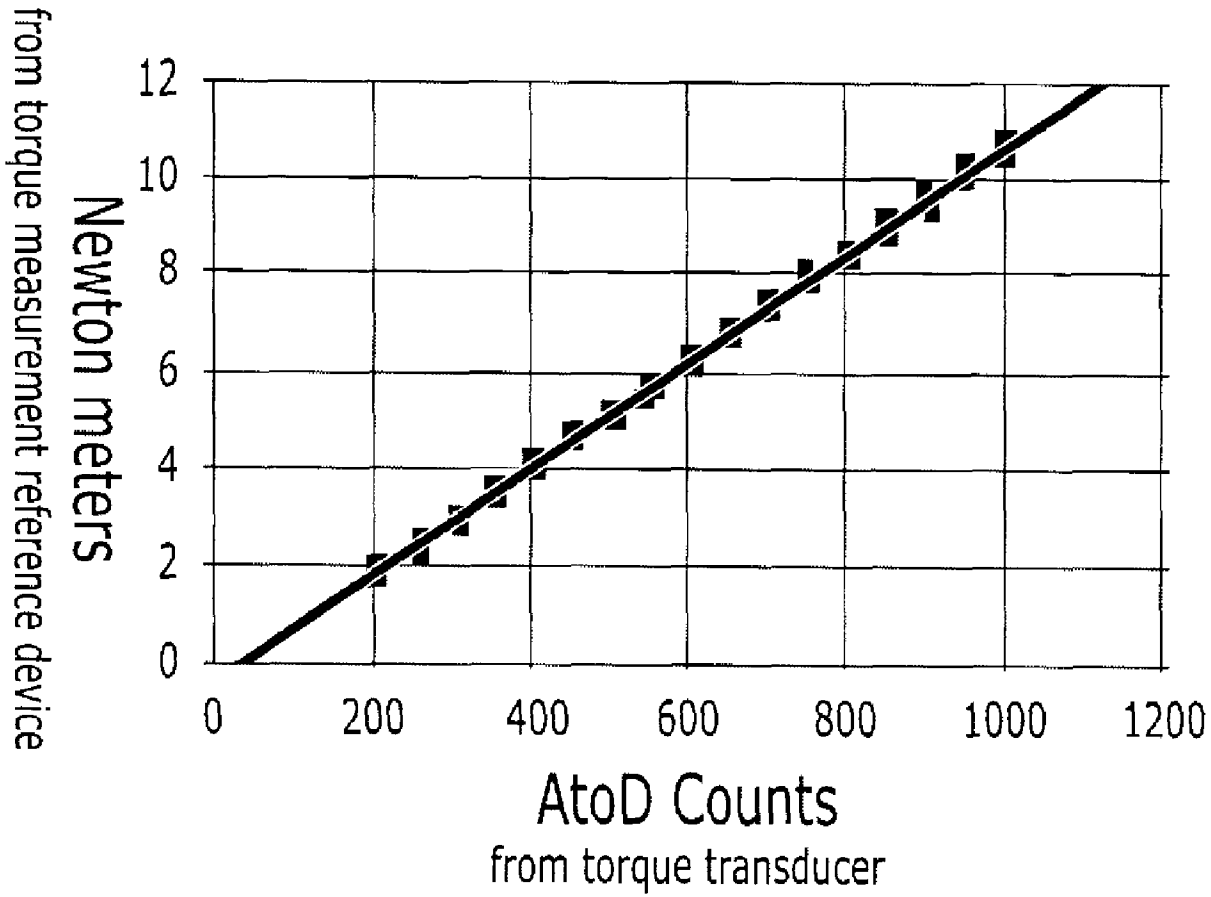

FIG. 4 is a flow chart illustrating a method for correlating measures of torque applied to a threaded fastener that is provided by a torque transducer according to another embodiment of the present invention; and FIG. 5 is a graphical representation of a mathematical relationship between a first measure of torque provided by a torque transducer and a second measure of torque provided by a torque measurement reference device according to another aspect of the present invention.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

As shown in FIG. 1, a torque tool 10 is provided according to the present invention for installing threaded fasteners 12. In this regard, the torque tool can install any number of different threaded fasteners, including bolts, nuts, screws and the like. As schematically depicted in FIG. 1, the threaded fasteners can be installed in two or more workpieces 14 in order to secure the workpieces together. Depending upon the application, the torque tool can install threaded fasteners in a variety of different workpieces. For example, threaded fasteners may be utilized to connect one frame section to another frame section. Alternatively, threaded fasteners may be installed by the torque tool of the present invention in order to attach a skin, such as the skin of an aircraft, a marine vessel, an automobile or the like, to a supporting frame or the like.

The torque tool 10 must therefore be adapted to install fasteners 12 in various types of joints. As known to those skilled in the art, the difference between hard joints and soft joints relates to the compression permitted by the joint when the workpieces are clamped together. In this regard, hard joints generally do not compress significantly when clamped together. For example, the joint formed by bolting together two pieces of flat plate steel is a hard joint. Alternatively, soft joints are formed by materials that do compress a significant amount upon the application of a clamp load. For example, a soft joint is defined by two pieces of steel having a thick gasket positioned between them.

Figure 2:
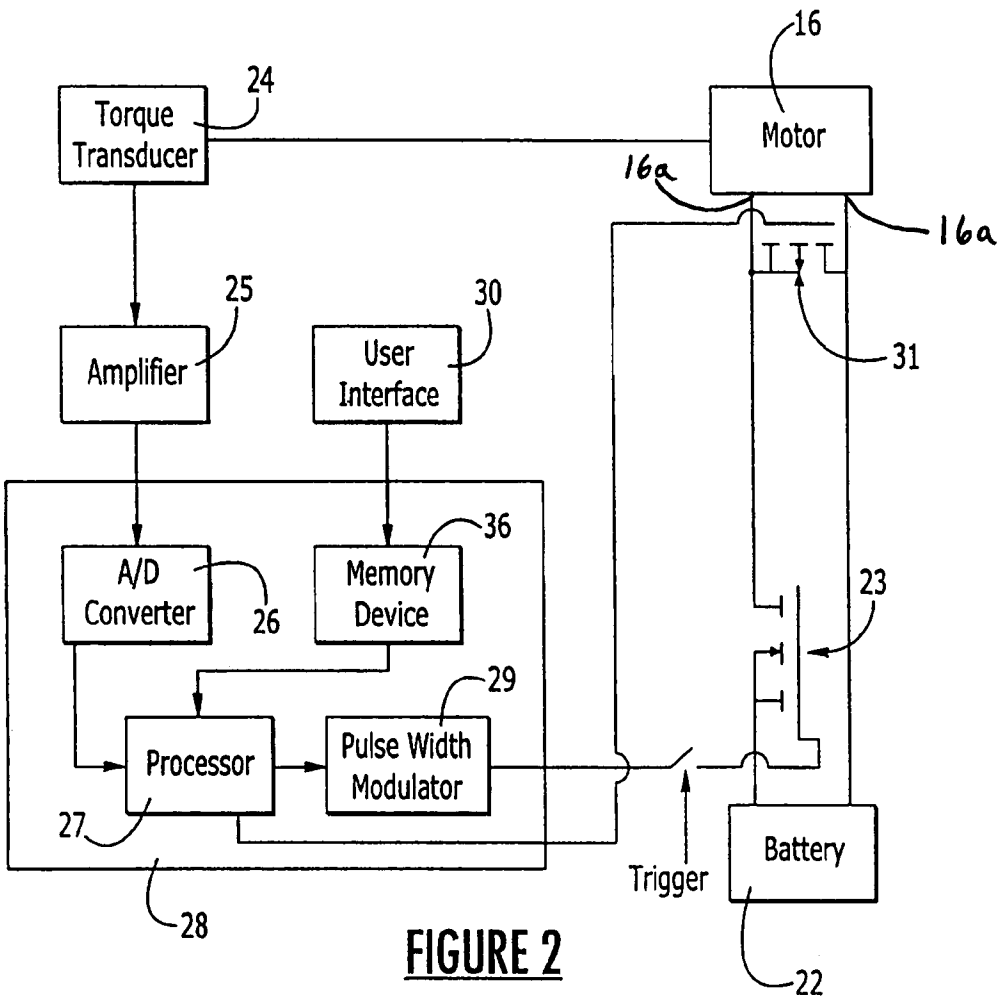
FIG. 2 is a block diagram of a torque tool of one embodiment of the present invention.

As shown in FIG. 2, the torque tool 10 includes a motor 16 for applying torque to the threaded fastener 12. As known to those skilled in the art, the motor generally causes a drive shaft to rotate about a lengthwise extending axis. An appropriate driver 18, such as a screwdriver bit, a socket driver or the like, is mounted to the drive shaft such that the motor also causes the driver to rotate. As shown in FIG. 1, for example, a screwdriver bit is attached to the drive shaft (not shown) by means of a chuck 20. By engaging the threaded fastener with the driver, the motor therefore rotatably advances the threaded fastener into the workpiece(s) 14.

The torque tool 10 of the present invention is advantageously portable such that the operator may readily carry the torque tool, such as along an assembly line, throughout a fabrication shop or the like. To facilitate the portability of the torque tool, the motor 16 is preferably battery-powered. As such, the torque tool advantageously includes at least one battery 22 that is switchably connected to the motor by switch 23 for providing power to the motor. Thus, the torque tool of the present invention need not be tethered to a fixed power supply, such as a pneumatic or hydraulic power supply or an AC power outlet, as required by conventional torque tools.

As shown in FIG. 2, the torque tool 10 includes a torque transducer 24 for providing a measure of the torque applied to the threaded fastener 12 as a result of the rotation of the draft shaft and, in turn, the associated driver 18. Various torque transducers may be utilized, as known to those skilled in the art, including, for example, a bridge-type torque transducer having a pair of excitation leads for receiving a power signal and a pair of signal leads that provide the output of the torque transducer. As also known to those skilled in the art, the torque transducer generally at least partially encircles the drive shaft such that the signals provided by the signal leads provide a measure of the torque applied to the threaded fastener by the motor 16. While various torque transducers may be utilized, one suitable torque tool is model no. Q38037-0021 provided by GSE Inc. of Farmington Hills, Mich. Further details of a torque transducer are not provided herein, as they are well understood by those skilled in the art. For reference purposes, however, U.S. Pat. No. 5,918,201 provides additional discussion and illustration of a torque transducer.

The torque transducer 24 does not generally provide a direct measure of the torque that is applied to a threaded fastener 12 in Newton meters or in other units in which torque is generally measured. Instead, the torque transducer, via the pair of signal leads, provides an analog value that may be amplified by amplifier 25 and then converted to a corresponding digital value, generally referred to as "A to D count", by an analog to digital converter 26. As explained hereinbelow, the digital value may be correlated to a respective measure of torque in Newton meters or the like such that the torque that has been applied to the threaded fastener may be readily determined by monitoring the output of the torque transducer.

As shown in FIG. 2, the torque tool 10 also includes a processing element 28, such as a microprocessor, a microcontroller or any other type of processing element known to those skilled in the art. The processing element at least partially controls operation of the motor 16, such as by controlling the speed at which the motor operates and, in turn, the speed at which the motor rotates the drive shaft and the driver 18. The processing element is responsive to the torque transducer 24 so as to receive the measure of torque applied to the threaded fastener that is provided by the torque transducer. The processing element may receive the measure of torque following its conversion to a digital value by the analog to digital converter 26 or the processing element may include the analog to digital converter as shown in FIG. 2.

Upon beginning to install a threaded fastener 12, the processing element 28 generally receives the measure of torque applied to the threaded fastener from the torque transducer 24. While the torque transducer may provide and the processing element may receive the measure of torque applied to the threaded fastener in various manners, the torque transducer typically provides a measure of the torque applied to the threaded fastener on a relatively continuous basis and the processing element generally reads or samples the measure of torque provided by the torque transducer. This measure of torque may be sampled at predefined intervals or, in the embodiment in which the processing element repeatedly executes a series of instructions, the processing element may sample the measure of torque each time that the series of instruction is executed such that the interval between instances in which the measure of torque is sampled may vary from sample to sample. As described below, the rate or frequency with which the processing element receives and reads the measure of torque applied to the threaded fastener as provided by the torque transducer may advantageously increase as the installation process proceeds.

Figure 3:
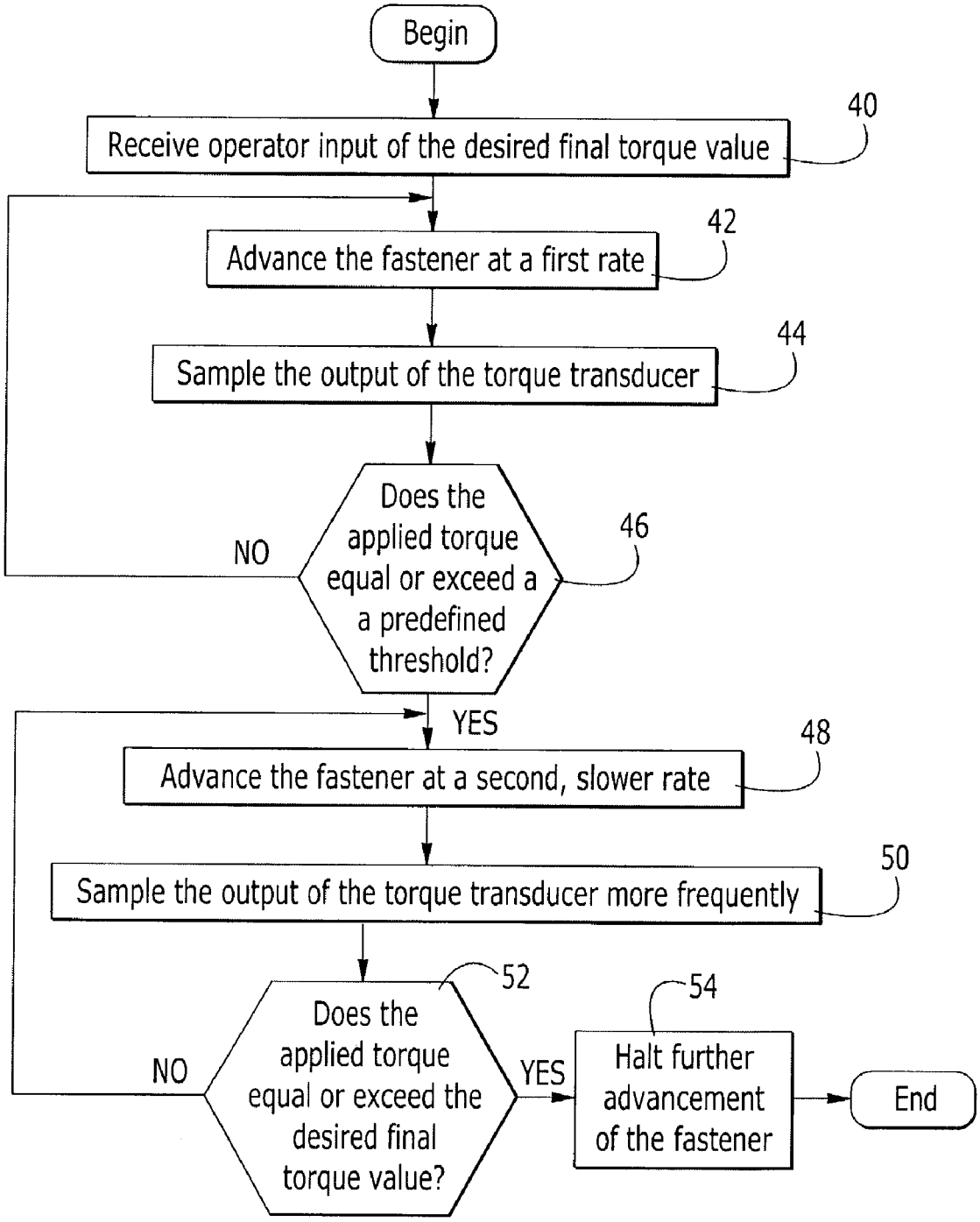
FIG. 3 is a flow chart illustrating operations performed by the torque tool and associated installation methods of one embodiment of the present invention.

Prior to the installation of the threaded fastener 12, a desired final torque value is defined as shown in block 40 of FIG. 3. While the desired final torque value may be a single value with which the processing element 28 is pre-programmed such that the torque tool 10 always installs threaded fasteners to the same pre-programmed final torque value, the torque tool of the present invention advantageously permits operator entry of a desired final torque value. Thus, the torque tool preferably includes a user interface 30 for receiving operator entry of the desired final torque value, such as in Newton meters or the like. While the torque tool may include various types of user interfaces, the torque tool of one embodiment depicted in FIG. 1 includes a keypad 32 for permitting operator entry of the desired final torque value and an associated display 34 for providing feedback to the operator to confirm that the desired value was entered. Regardless of the configuration, the user interface is disposed in electrical communication with the processing element such that the desired final torque value that is entered by the operator is provided to the processing element. As shown in FIG. 2, the processing element generally includes an associated memory device 36 for storing, among other data, the desired final torque value entered by the operator.

During installation of the threaded fastener 12, the processing element 28, such as processor 27 of the embodiment of FIG. 2, may therefore determine the relative stage of the installation by comparing the measure of the torque applied to the threaded fastener that is provided by the torque transducer 24 to the desired final torque value. In order to permit a proper comparison, the measure of torque applied to the threaded fastener that is provided by the torque transducer is preferably converted or correlated by the processing element, as described below, to a corresponding measure of torque in Newton meters or the like for a ready comparison to the desired final torque value entered by the operator. Advantageously, the processing element can determine when the torque applied to the threaded fastener has reached a predefined threshold. The predefined threshold may be defined in various manners. However, this predefined threshold is typically defined in terms of the desired final torque value. For example, the predefined threshold may be defined to be a predetermined percentage, such as 50%, of the desired final torque value. Once the processing element determines that the torque applied to the threaded fastener has reached a predefined threshold, the processing element may alter the operation of the torque tool 10 in some fashion so as to better control installation of the threaded fastener.

In this regard, the processing element 28 may control the motor 16 to slow further advancement of the threaded fastener 12 from a first rate shown in block 42 of FIG. 3 to a second, slower rate shown in block 48 upon detecting that the applied torque has reached the predefined threshold as shown in block 46. The processing element can control the motor in various manners. In the embodiment depicted in FIG. 2, however, the processing element also includes a pulse width modulator 29 that is driven by the processor 27 and that provides a pulsed output, once the trigger is actuated, that alternately closes the switch 23 that connects the battery 22 to the motor. As shown, the switch may be embodied by a power field effect transistor (FET) that is alternately rendered conductive by the pulsed output of the pulse width modulator. However, the switch may be embodied differently if so desired. In order to alter the rate at which the motor advances the fastener, the processor of the illustrated embodiment simply alters the duty cycle with larger duty cycles generally corresponding to faster rates of advancement and, conversely, shorter duty cycles generally corresponding to slower rates of advancement.

By slowing further advancement of the threaded fastener 12, the processing element 28 will be better able to halt installation of the threaded fastener once the processing element detects that the torque applied to the threaded fastener has reached the desired final torque value. As such, the torque tool may avoid the undesirable application of excessive torque to the threaded fastener, which may damage the threaded fastener and/or the workpiece(s) 14 within which the threaded fastener is being installed. The amount by which the processing element slows the further advancement of the threaded fastener may vary depending upon the manner in which the processing element is configured.

In instances in which the torque tool 10 will be primarily utilized to install threaded fasteners 12 in hard joints, for example, the torque tool may significantly slow further advancement of the threaded fastener since the threaded fastener generally need not be rotated much further once the torque applied to the threaded fastener reaches 50% of the desired final torque value. In this regard, a threaded fastener installed in a hard joint must generally only be rotated about 20 to 50 degrees once 50% of the desired final torque value has been applied. Alternatively, a torque tool designed primarily to install threaded fasteners in soft joints may be designed such that the processing element 28 does not slow further advancement of the threaded fastener as significantly since a threaded fastener must generally be rotated through a larger angle to complete the installation within a soft joint even once 50% of the desired final torque value has been applied. For example, a threaded fastener installed in a soft joint must still be rotated through an angle of between about 300 and 400 degrees to complete the installation, once the processing element has determined that 50% of the desired final torque value has been applied to the threaded fastener.

Additionally, the processing element 28 may detect multiple predefined thresholds and may differently control the motor 16 following the detection of each threshold. In this regard, the advancement of the threaded fastener 12 may be slowed in a stairstep-like fashion as the processing element further slows the motor upon detecting increasingly larger predefined thresholds.

In addition to or instead of slowing further advancement of the threaded fastener 12 once the processing element 28 has detected that the torque applied to the threaded fastener has reached a predefined threshold, the processing element may begin receiving a measure of torque applied to the threaded fastener from the torque transducer 24 at more frequent intervals. As described above, the processing element may receive or sample the measure of torque provided by the torque transducer at a rate that is no greater than a first frequency as shown in block 44 of FIG. 3, prior to detecting that the predefined threshold had been reached. After detecting that the predefined threshold has been reached as shown in block 46, however, the processing element can sample the measure of torque provided by the torque transducer more frequently, such as at a second, faster frequency as shown in block 50. This more frequent sampling of the measure of torque applied to the threaded fastener that occurs after reaching the predefined threshold permits the processing element to more quickly detect that the desired final torque value has been reached. As such, the torque tool 10 of this advantageous embodiment can also avoid applying excessive amounts of torque to the threaded fastener.

As described above, in conjunction with the processing element slowing further advancement of the threaded fastener 12, multiple different predefined thresholds may be established with the processing element sampling the output of the torque transducer at a different rate after reaching each different predefined threshold. Thus, the rate at which the processing element samples the output of the torque transducer may gradually be stepped up as increasingly larger predefined thresholds are reached.

Upon determining that the desired final torque value has been applied to the threaded fastener 12, the processing element 28 preferably halts further installation of the threaded fastener. See blocks 52 and 54 of FIG. 3. In one advantageous embodiment, the processing element halts further advancement of the threaded fastener by opening the switch 23, such as by ceasing output from the pulse width modulator 29, and then closing the switch 31 that electrically connects the pair of power terminals 16*a* of the motor 16. The pair of power terminals are therefore electrically shorted once the processing element has determined that the torque applied to the threaded fastener has reached the desired final torque value. By electrically shorting the pair of power terminals of the motor, the motor quickly, if not instantly, halts further advancement of the threaded fastener.

The torque tool 10 of the present invention therefor offers a number of advantages. The torque tool is advantageously portable as a result of being powered by a battery 22 and may therefore be readily carried along an assembly line, throughout a fabrication shop or the like without being tethered to a fixed power supply. Additionally, the torque tool permits operator entry of the desired final torque value and then monitors the torque applied to the threaded fastener 12 during installation to halt further advancement of the threaded fastener once the desired final torque value has been applied. As a result, the torque tool need not be taken to a calibration laboratory in order to be re-calibrated so as to install threaded fasteners to a different final torque value as required by many conventional torque tools. Further, the processing element 28 of the torque tool of the present invention monitors the output of the torque transducer 24 so as to alter the operation of the torque tool, such as by slowing the advancement of the threaded fastener and/or more frequently sampling the output of the torque transducer, once a predefined threshold has been reached.

As mentioned above, the torque transducer 24 does not generally provide a direct measure of the torque applied to a threaded fastener 12 in Newton meters or any other units in which torque is commonly measured. Instead, the torque transducer provides an analog and, following its conversion by an analog to digital converter 26, a digital value that represents the current measure of the torque. In order to correlate the indirect measure of torque provided by the torque transducer to the calibrated measure of the torque applied to the threaded fastener in Newton meters or the like, a calibration method is also provided as shown in FIG. 4.

According to this method, at least one threaded fastener 12 is repeatedly installed with different amounts of torque applied thereto during at least two installations. Typically, a plurality of threaded fasteners are installed with different amounts of torque applied to some, if not all, of the threaded fasteners. During each installation, the torque applied to a threaded fastener is measured by both the torque transducer 24 and a torque measurement reference device which provide first and second measures, respectively, of the applied torque. See blocks 60–64 of FIG. 4. While the torque transducer provides a value that is indirectly representative of the torque applied to a threaded fastener, the torque measurement reference device preferably provides a direct measure of the torque applied to a threaded fastener in Newton meters or other units in which torque is commonly expressed. Various types of torque measurement reference devices may be utilized with the measure of torque provided by the respective torque measurement reference device having increased precision relative to the measure provided by the torque transducer. In one embodiment, for example, a torque/angle measuring system bearing Model No. 5413-2021 and provided by Schatz USA, Inc. of Troy, Mich., is utilized to obtain a direct measure of the torque applied to a threaded fastener as known to those skilled in the art.

In the embodiment depicted in FIG. 4, a predetermined number of fasteners 12 are installed to the same desired final torque value as shown in block 66, before selecting a different desired final torque value as shown in block 68 and repeating the process. Once fasteners have been installed for all of the desired final torque values as shown in block 70 and based upon the first and second measures of torque obtained by the torque transducer and the torque measurement reference device, respectively, during each installation, a mathematical relationship between the first and second measures of torque may be determined as shown in block 72. In this regard, a regression analysis, such as a linear regression analysis, may be applied to define the mathematical relationship between the first and second measures of torque. By way of example, a graphical representation of a linear relationship defined between the A to D counts provided by the torque transducer 24 and corresponding measurements of torque in Newton meters by a torque measurement reference device is shown in FIG. 5.

Based upon the mathematical relationship correlating the A to D counts provided by the torque transducer 24 with measurements of the applied torque in Newton meters, the torque tool 10 of the present invention can communicate with the operator via the user interface 30 with measures of torque, either the applied torque or the desired final torque, expressed in Newton meters while internally utilizing a torque transducer that provides a measure of the applied torque, not in Newton meters, but in A to D counts. Thus, the desired final torque value entered by an operator is generally converted by the processing element 28 into a corresponding number of A to D counts. The predefined threshold may then be defined based upon the A to D counts that correspond to the desired final torque value. Additionally, once the installation of the threaded fastener 12 is completed, the final measure of applied torque provided by the torque transducer 24 may be converted by the processing element to a corresponding measure of the applied torque in Newton meters in accordance with the predefined mathematical relationship. The actual final applied torque may then be displayed for the operator to view on the display 34 and/or stored in the memory device 36 associated with the processing element, if desired.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A portable torque tool comprising:

a motor for applying torque to a threaded fastener;

at least one battery for providing power to said motor;

a torque transducer for providing a measure of the torque applied to the threaded fastener; and a processing element for at least partially controlling operation of said motor, said processing element to control a speed of said motor to advance the threaded fastener at a first rate, to receive the measure of torque applied to the threaded fastener and configured to determine that the torque applied to the threaded fastener has reached a predefined threshold and to thereafter reduce the speed to said motor that is otherwise capable of continuing to operate at a greater speed sufficient to advance the threaded fastener at the first rate such that the threaded fastener is advanced at a second rate that is slower than the first rate at which the threaded fastener was advanced prior to determining that the torque applied to the threaded fastener had reached the predefined threshold.

2. A torque tool according to claim 1 wherein said processing element is configured to determine that the torque applied to the threaded fastener is at least a predefined percentage of a desired final torque value.

3. A torque tool according to claim 1 wherein said processing element is also configured to receive the measure of torque applied to the threaded fastener from said torque transducer at more frequent intervals following a determination that the torque applied to the threaded fastener has reached the predefined threshold than prior to the determination that the torque applied to the threaded fastener has reached the predefined threshold.

4. A torque tool according to claim 1 wherein said motor comprises a pair of power terminals, and wherein said processing element is further configured to direct that the pair of power terminals of said motor be electrically shorted following a determination that the torque applied to the threaded fastener has reached a desired final torque value.

5. A torque tool according to claim 1 further comprising a user interface in communication with said processing element for permitting operator entry of a desired final torque value.

6. A torque tool comprising:

a motor for applying torque to a threaded fastener;

a torque transducer for providing a measure of the torque applied to the threaded fastener; and a processing element for at least partially controlling operation of said motor, said processing element receiving the measure of torque applied to the threaded fastener from said torque transducer, said processing element configured to determine that the torque applied to the threaded fastener has reached a predefined threshold and to thereafter receive the measure of torque applied to the threaded fastener from said torque transducer at more frequent intervals.

7. A torque tool according to claim 6 wherein said processing element is configured to determine that the torque applied to the threaded fastener is at least a predefined percentage of a desired final torque value.

8. A torque tool according to claim 6 wherein said processing element is also configured to control said motor to slow further advancement of the threaded fastener following a determination that the torque applied to the threaded fastener has reached the predefined threshold.

9. A torque tool according to claim 6 wherein said motor comprises a pair of power terminals, and wherein said processing element is further configured to direct that the pair of power terminals of said motor be electrically shorted following a determination that the torque applied to the threaded fastener has reached a desired final torque value.

10. A torque tool according to claim 6 further comprising at least one battery for providing power to said motor.

11. A torque tool according to claim 6 further comprising a user interface in communication with said processing element for permitting operator entry of a desired final torque value.

12. A method of installing a threaded fastener with a portable torque tool, the method comprising:

providing power to the portable torque tool with at least one battery;

applying torque to the threaded fastener while power is provided to the portable torque tool by the at least one battery, thereby advancing the threaded fastener;

determining when the torque applied to the threaded fastener has reached a predefined threshold; and slowing further advancement of the threaded fastener from a first rate to second rate once the torque applied to the threaded fastener is determined to have reached the predefined threshold, wherein slowing further advancement of the threaded fastener comprises reducing a speed of a motor of the portable torque tool that is otherwise capable of continuing to operate at a greater speed sufficient to advance the threaded fastener at the first rate such that the threaded fastener is thereafter advanced at the second rate that is slower than the first rate at which the threaded fastener was advanced prior to determining that the torque applied to the threaded fastener had reached the predefined threshold.

13. A method according to claim 12 wherein determining when the torque has reached the predefined threshold comprises determining when the torque applied to the threaded fastener is at least a predefined percentage of a desired final torque value.

14. A method according to claim 12 further comprising obtaining a measure of the torque applied to the threaded fastener at more frequent intervals following a determination that the torque applied to the threaded fastener has reached the predefined threshold than prior to the determination that the torque applied to the threaded fastener has reached the predefined threshold.

15. A method according to claim 12 further comprising electrically shorting a pair of power terminals of a motor that applies the torque to the threaded fastener following a determination that the torque applied to the threaded fastener has reached a desired final torque value.

16. A method according to claim 12 further comprising receiving operator entry of a desired final torque value.

17. A method of installing a threaded fastener comprising:

applying torque to the threaded fastener to thereby advance the threaded fastener;

obtaining a measure of the torque applied to the threaded fastener;

determining when the torque applied to the threaded fastener has reached a predefined threshold; and obtaining the measure of the torque applied to the threaded fastener at more frequent intervals once the torque applied to the threaded fastener is determined to have reached the predefined threshold.

18. A method according to claim 17 wherein determining when the torque has reached the predefined threshold comprises determining when the torque applied to the threaded fastener is at least a predefined percentage of a desired final torque value.

19. A method according to claim 17 further comprising slowing further advancement of the threaded fastener once the torque applied to the threaded fastener is determined to have reached the predefined threshold.

20. A method according to claim 17 further comprising electrically shorting a pair of power terminals of a motor that applies the torque to the threaded fastener following a determination that the torque applied to the threaded fastener has reached a desired final torque value.

21. A method according to claim 17 further comprising receiving operator entry of a desired final torque value.

22. A method of defining a mathematical relationship between a first measure provided by a torque transducer of torque applied to a threaded fastener and a second measure provided by a torque measurement reference device of torque applied to the threaded fastener, the method comprising:

repeatedly installing at least one threaded fastener with different amounts of torque applied thereto during at least two installations;

measuring the torque applied to the threaded fastener during each installation with both the torque transducer and the torque measurement reference device and providing first and second measures, respectively, of the applied torque during the respective installation; and determining the mathematical relationship between the first and second measures of torque provided the torque transducer and the torque measurement reference device, respectively, wherein the mathematical relationship permits a conversion from the first measure of torque provided by torque transducer to the second measure of torque provided by the torque measurement reference device.

23. A method according to claim 22 wherein measuring the torque applied to the threaded fastener comprises:

obtaining a direct measure of the torque from the torque measurement reference device; and obtaining a value indirectly representative of the torque from the torque transducer.

24. A method according to claim 22 wherein measuring the torque applied to the threaded fastener comprises obtaining a more precise measure of the torque from the torque measurement reference device than from the torque transducer.

25. A method according to claim 22 wherein determining the mathematical relationship comprises employing a regression analysis to determine the mathematical relationship between the first and second measures of torque.

26. A method according to claim 25 wherein employing a regression analysis comprises employing a linear regression analysis to determine the mathematical relationship between the first and second measures of torque.

* * * * *

UNITED STATES PATENT AND TRADEMARK OFFICE

CERTIFICATE OF CORRECTION

PATENT NO. : 7,062,979 B2
APPLICATION NO. : 10/391836
DATED : June 20, 2006
INVENTOR(S) : Day et al.

It is certified that error appears in the above-identified patent and that said Letters Patent is hereby corrected as shown below:

Column 11,

Line 16, "to" should read --of--.

Column 12,

Line 23, after "rate to" insert --a--.

Signed and Sealed this

Twenty-sixth Day of December, 2006

JON W. DUDAS
*Director of the United States Patent and Trademark Office*